United States Patent [19]

Saponara

[11] 4,033,091

[45] July 5, 1977

[54] PRESSURIZING CLOSURE APPARATUS

[76] Inventor: Arthur Michael Saponara, 144-32 Barclay Ave., Flushing, N.Y. 11355

[22] Filed: Aug. 24, 1976

[21] Appl. No.: 717,114

[52] U.S. Cl. ..... 53/88; 220/367; 215/228

[51] Int. Cl.[2] ..... B65B 31/04

[58] Field of Search ..... 53/88; 220/367; 215/228

[56] References Cited

UNITED STATES PATENTS

| | | | |
|---|---|---|---|
| 3,602,387 | 8/1971 | Patnaude | 215/228 X |
| 3,853,222 | 12/1974 | Helms | 53/88 X |

*Primary Examiner*—Travis S. McGehee
*Attorney, Agent, or Firm*—Robert D. Farkas

[57] ABSTRACT

This disclosure pertains to a carbonated beverage container closure apparatus adapted to be removably secured to the container's mouth. A valve is biased to close an opening in the closure having the closing biased forces reinforced by the pressurized gas within the container. A pump apparatus is threadingly engaged on the closure device and is adapted with a check valve such that manual operation of the pump causes the valve in the closure device to open whilst the check valve is closed and air, under pressure, is injected into the container. The pump apparatus may be removed from the container closure device, enabling the container to be stored in a substantially non-heightened profile and enabling the pump apparatus to re-pressurize other containers equipped with similar closure devices.

8 Claims, 4 Drawing Figures

PRESSURIZING CLOSURE APPARATUS

BACKGROUND OF THE INVENTION

1. Field of the Invention

This invention relates to closure devices and pressurizing pumps in the classes utilized to apply increased internal pressure to containers utilizing closure devices.

2. Description of the Prior Art

The prior art includes a variety of closure devices which are removably affixed to the mouth of containers. U.S. Pat. No. 3,557,986 issued on Jan. 26, 1971 to W. T. Poole, Jr. teaches a unitary container closure having an element thereof in touching engagement with the mouth of the container. The outermost surface of the aforementioned element forms one wall of a closed flexible wall cavity abutting thereto. A check value opening is installed in the element permitting pressurized air, obtained by compressing the cavity, to enter the container. An opening in the cavity walls serves as an entranceway for air into the cavity and may be selectively closed by the thumb of the user during the cavity wall compression stage or equipped with an additional check valve permitting the entrance of air as the cavity returns to its enlarged state and preventing the escapage of air when the cavity is manually compressed. The Poole patent requires the use of a complicated and expensive pump enclosure apparatus for each container whose internal pressure is to be maintained during periods of non use. Furthermore, manual forces, directly applied to the Poole cavity produce pressurized forces within the container of moderate magnitudes.

SUMMARY OF THE INVENTION

A primary object of the present invention is to provide a container closure device which acts as a carbonated beverage container closure, that may be utilized with a separable pump apparatus to re-pressurize the interior of the container when the pump apparatus is attached to the closure and is manually manipulated.

Another object is to provide a container closure device compatible with screw top type beverage containers whose useful life is indefinite in nature.

Still another object is to provide a pump apparatus which easily pneumatically engages the closure device and can be readily removed therefrom without disturbing the engagement of the closure device and the container.

Yet another object is to provide a pump apparatus which utilizes a linkage assembly to obtain a mechanical advantage over the applied manual forces thereto, thereby enhancing the ability of the pump to produce compressed air at great pressures.

Carbonated beverages, whose volume occupies only a portion of a sealed container will go "flat" due to the tendency of the carbonated gases to achieve an equal pressure level to that of the air abutting the liquid within the container. As the liquid volume to air volume ratio decreases the ability of the carbonated gases within the liquid to be maintained at high pressure due to the air pressure adjacent thereto, is further diminished.

The instant invention overcomes this objection by allowing the user to re-pressurize the air volume on each occasion following an opening of the container in order to remove quantities of the liquid beverage therefrom. A special container closure may be utilized in conventional fashion to cover the container mouth and may be removed therefrom so as to gain pouring access to the contents of the container. A separate pump assembly engages the exterior surface of the special container closure device on those occasions when it is desired to re-pressurize the air volume within the container. Alternate manual manipulations of the closure causes a check valve in the special container closure device and another check valve in the pump assembly to reciprocate in opposite closed and opened positions so as to cause surges of compressed air to be injected, through the closure device, into the container. After use, the inexpensive closure device may be removed, and stored, or utilized on other containers fitted with additional special closure devices. A container adapted with a special closure device alone has a high profile substantially equal to the height of the container alone, thereby allowing the clos-d container to be conveniently stored in the usual locations, such as in refrigerators and the like.

These objects, as well as other objects of the present invention, will become more readily apparent after reading the following description of the accompanying drawings.

DESCRIPTION OF THE PREFERRED EMBODIMENT

Figure 1:
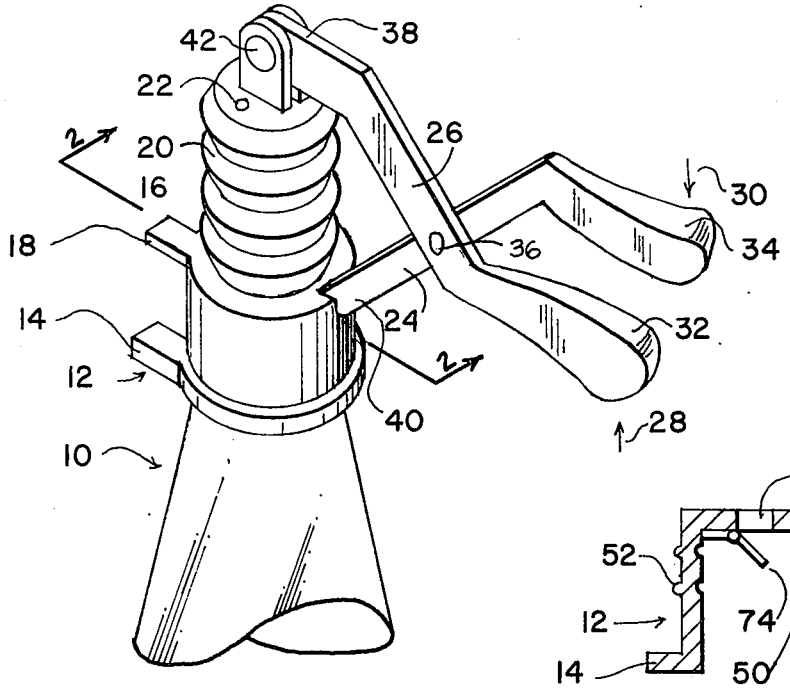
FIG. 1 is a perspective view of the container closure device fastened to a portion of a beverage container, shown supporting the separable pump apparatus.

The structure and method of fabrication of the present invention is applicable to a container closure device having a substantially inverted U-shaped cross-section whose interior cylindrical surfaces are adapted with internal threads, enabling threading engagement of the closure device with the external threads adjacent the mouth portion of a beverage container. If desired, the closure device may be fitted with an O ring seal so as to compressively engage the portions of the container adjacent the mouth of containers that do not have external threads thereon, sealing the container closure device to the exterior portions of the container adjacent the mouth thereof.

The lateral surface of the closure device extending parallel to the free edges defining the mouth of the container, is fitted with a check valve preventing pressurized gas from within the container from emerging therethrough. The preferred embodiment utilizes a spring and ball check valve residing within the inward portions of the container adjacent the mouth. An alternate embodiment utilizes a flat type closure biased against an opening piercing the lateral surface of the closure device.

The closure device has a plurality of external threads on an exterior cylindrical surface co-axially aligned with the neck portion of the container. The pump apparatus is adapted with a cylindrically internally threaded portion which may be threadingly engaged on the external cylindrical surface of the closure device. A flange-like tab extends radially outwardly from both the closure device and the pump apparatus enabling each to be rotated independently of the other so that the pump apparatus may be conveniently installed and removed from the closure device, and, in similar fashion, the closure device may be conveniently installed and removed from about the mouth of the container.

A bellows unit is fitted to the cylindrical closure engaging portion of the pump apparatus having the free end thereof affixed to one end of one arm of a scissor-like pair of handles. An adjacent end of the other handle is affixed to the cylindrical portion of the pump assembly. Compressive forces applied to the other end of the scissor-like handles causes the bellows unit to compress and to inject the air compressed therein through the check valve in the closure device and into the confines of the beverage container. Another check valve, installed in the surface of the bellows unit enables the bellows to fill with air whilst assuming an uncompressed heightened condition, as the other end of the handles are released. Repeated squeezing like forces on the other ends of the handles permits the air pressure, injected into the container, to be built up, in step-wise fashion, each time the other ends of the handles are successively squeezed towards each other. The length of the handles, extending outwardly from the pivot point joining them, provides a mechanical advantage which allows the user to apply moderate forces to the handles doing the squeezing thereof whilst creating substantial pressure levels within the container.

Now referring to the Figures, and more particularly to the embodiment illustrated in FIG. 1 showing a beverage container 10 to which is fitted a closure device 12. Closure device tab 14 extends outwardly from the closure device facilitating tightening and loosening of the closure device on portions of the neck of the container 10. Pump assembly 16 is shown assembled to closure device 12 and is also fitted with a pump device tab 18 facilitating removal and tightening of the pump device onto the closure device. Bellows unit 20 are utilized to obtain compressed air to be injected into container 10. Opening 22, in the bellows unit, permits air to enter the interior of the bellows unit at those times that the bellows unit is not injecting air into the container 10. Handles 24 and 26 are manually operated by the application of compressive forces applied in the directions of arrows 28 and 30 at points 32 and 34. Pivot rod 36 creates a scissor-like action at ends 38 and 40 of handles 24 and 26. Pivot rod 42 pivotably fastens end 38 of handle 26 to the upper part of bellows 20. The distance separating ends 32 and 34 from pivot rod 36 is greater than the distance separating pivot rod 36 from end 38 and end 40. Thus, forces applied at ends 32 and 34 are amplified relative to the applied forces at ends 38 and 40.

Figure 2:
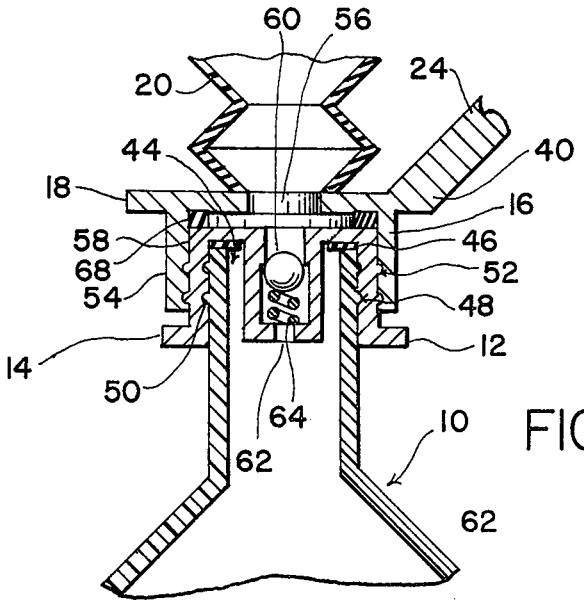
FIG. 2 is a partial cross-sectional view of the pump apparatus and the mouth portion of the container, separated by the container closure device.

FIG. 2 illustrates container 10 whose uppermost marginal edges 44 are sealed by gaskets 46, compressed by closure device 12. Threads 48 on the container 10 engage threads 50, so as to secure closure device 10 adjacent marginal edges 44. Tab 14 permits closure device 12 to be manually manipulated into and out of threading engagement with the exterior surface of container 10, adjacent marginal edges 44. Pump device 16 is threadingly engaged on closure device 12 utilizing threads 52 therefor. The pump device can be removed from the closure device whilst leaving the closure device fastened to container 10. Tab 18 extends radially outwardly from cylindrical surface 54 and is utilized to manipulate pump assembly 16 on closure device 12. Gasket 68 seals pump device 16 to closure device 12. Bellows unit 20 communicates through opening 56 therein to the lateral surface 58 of closure device 12. Openings 60 and 62 permit air, in compressed form, located within bellows unit 20 to be communicated to the interior portions of container 10 at point 62. Sring 64 maintains ball 66 in an uppermost position preventing compressed air or other compressed gases present at point 62 from escaping from the confines of container 10, whilst allowing compressed air within bellows unit 20, if of sufficient pressure level, to overcome the bias forces of spring 64 so as to inject compressed air into the container.

Figure 3:
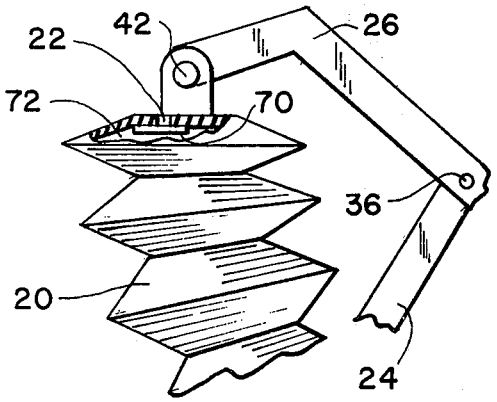
FIG. 3 is a partial side-elevation view of the pump apparatus as shown in FIG. 1.

FIG. 3 illustrates bellows unit 20 to which handle 26 is pivotably attached, utilizing pivot rod 42. Inlet opening 22 communicates to a flapper valve 70, within the bellows unit, such that the valve closes when the pressure at point 72 exceeds atmospheric pressure and opens, communicating opening 22 to point 72 thereby.

Figure 4:
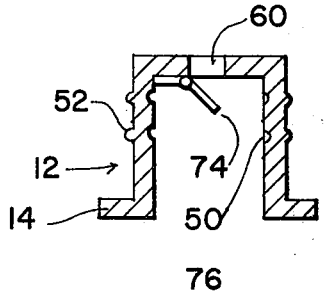
FIG. 4 is a cross-sectional view of an alternate embodiment of the container closure device.

FIG. 4 represents an alternate embodiment for closure device 12 as shown in FIG. 2. Flapper valve 74 closes opening 60 when the pressure level at point 76 exceeds that of atmospheric pressure, thus supplanting spring 64 and ball 66 as shown in FIG. 2.

One of the advantages is to provide a container closure device which acts as a carbonated beverage container closure, that may be utilized with a separable pump apparatus to repressurize the interior of the container when the pump apparatus is attached to the closure and is manually manipulated.

Another advantage is to provide a container closure device compatible with screw top type beverage containers whose useful life is indefinite in nature.

Still another advantage is to provide a pump apparatus which easily pneumatically engages the closure device and can be readily removed therefrom without disturbing the engagement of the closure device and the container.

Yet another advantage is to provide a pump apparatus which utilizes a linkage assembly to obtain a mechanical advantage over the applied manual forces thereto, thereby enhancing the ability of the pump to produce compressed air at great pressures.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows. 9n

I claim:

1. A pressurizing closure apparatus for closing the opening in a container that contains a carbonated liquid or the like comprising in combination:

a closure device for removable engagement over said opening in said container, said closure device for sealing said opening;

first check valve means disposed in said closure device that passes air in a first direction through said closure device to the internal volume of said container and opposes the passage of said air in the reverse direction and out of said container;

a pump device for intermittantly generating compressed air within a cavity thereof, second check valve means disposed in the walls of said cavity, said second check valve means passing air in a second direction through said walls of said cavity to the internal volume of said cavity and opposing the passage of air in the reverse direction and out of said cavity, said pump device removably secured to said closure device utilizing pump device securing means therefor; and handle means, said handle means for providing said compressed air within said cavity upon the application of manually applied force thereto.

2. The pressurizing closure apparatus as claimed in claim 1 wherein said first check valve means comprises a ball, a spring, said ball being biased outwardly against an opening in the surface of said closure device by said spring.

3. The pressurizing closure apparatus as claimed in claim 1 wherein said first check valve means comprises a flapper valve, said flapper valve closing an opening in the surface of said closure device when said internal volume of said container attains a pressure level greater than the pressure level of the outside air surrounding said container.

4. The pressurizing closure apparatus as claimed in claim 1 further comprising said closure device having a cylindrical external surface, first threads being disposed on said cylindrical exterior surface, said first threads for threading engagement with said pump device, tab means extending radially outwardly from said cylindrical exterior surface, a lateral surface being fixedly secured to one end of said cylindrical exterior surface, said first check valve means being disposed within said lateral surface.

5. The pressurizing closure apparatus as claimed in claim 4 wherein said closure device further comprises second threads being disposed on an innermost cylindrical surface thereof, said innermost cylindrical surface co-axially aligned with said cylindrically exterior surface, said second threads for threading engagement with the external surface of said container adjacent said opening in said container.

6. The pressurizing closure apparatus as claimed in claim 4 wherein said pump device comprises a bellows assembly, one end of said bellows assembly fixedly secured to said pump device securing means, the other end of said bellows assembly enclosing said cavity thereof.

7. The pressurizing closure apparatus as claimed in claim 6 wherein said handle means comprises a pair of handles, one end of one of said pair of handles fixedly secured to said pump device securing means, one end of the other of said pair of handles in touching engagement with said other end of said bellows assembly, mechanical advantage means for applying greater forces to said one end of said one of said pair of handles and said one end of said other of said pair of handles than said manually applied forces to the other end of said one of said pair of handles and the other end of said other pair of handles.

8. The pressurizing closure apparatus as claimed in claim 7 wherein said pump device further comprises a third cylindrical interior surface, said third cylindrical interior surface having third threads disposed thereon, said third threads for threading engagement with said first threads on said cylindrical external surface of said closure device.

* * * * *